US011024268B1

(12) United States Patent
Best

(10) Patent No.: US 11,024,268 B1
(45) Date of Patent: Jun. 1, 2021

(54) PIPE ORGAN TREMULANT

(71) Applicant: Kenneth Burton Best, Elmhurst, IL (US)

(72) Inventor: Kenneth Burton Best, Elmhurst, IL (US)

( * ) Notice: Subject to any disclaimer, the term of this patent is extended or adjusted under 35 U.S.C. 154(b) by 143 days.

(21) Appl. No.: 16/566,871

(22) Filed: Sep. 10, 2019

(51) Int. Cl.
*G10B 3/18* (2006.01)
*G10B 3/06* (2006.01)

(52) U.S. Cl.
CPC *G10B 3/18* (2013.01); *G10B 3/06* (2013.01)

(58) Field of Classification Search
CPC ..... G10B 3/18; G10B 3/06; G10B 3/08
See application file for complete search history.

(56) References Cited

U.S. PATENT DOCUMENTS

| | | | | |
|---|---|---|---|---|
| 53,803 | A | 4/1866 | Foster | |
| 59,128 | A | 10/1866 | Hoddick | |
| 59,354 | A | 11/1866 | Burdett | |
| 65,171 | A | 5/1867 | Carpenter | |
| 65,899 | A | 6/1867 | Louis | |
| 87,427 | A | 3/1869 | Pain | |
| 101,742 | A | 4/1870 | Kerigan | |
| 107,549 | A | 9/1870 | Sanborn | |
| 153,150 | A | 7/1874 | Burdett | |
| 160,605 | A | 3/1875 | Lomas | |
| 164,871 | A | 6/1875 | Parker | |
| 177,610 | A | 5/1876 | Amo | |
| 203,932 | A | 5/1878 | Potter | |
| 206,008 | A | 7/1878 | Ewell | |
| 247,099 | A | 9/1881 | Norton | |
| 478,552 | A | 7/1892 | Bassett | |
| 797,719 | A | 8/1905 | Challinor | |
| 1,243,644 | A | 10/1917 | Van Valkenburg | |
| 1,262,640 | A | 4/1918 | Cloetens | |
| 1,439,652 | A | 12/1922 | Till | |
| 1,619,532 | A | 3/1927 | Niemann | |
| 1,716,630 | A * | 6/1929 | Gottfried | G10B 3/08 84/349 |
| 2,074,428 | A | 3/1937 | Quave | |
| 2,198,160 | A | 4/1940 | Gollnick | |
| 2,633,047 | A | 3/1953 | Glatter-Gotz | |
| 3,018,682 | A | 1/1962 | Imhoff | |

(Continued)

OTHER PUBLICATIONS

"Jim Explains Tremulant," by George Lipp; youtube.com video; https://www.youtube.com/watch?v=eIOAYqaHlao, published Feb. 2, 2012, accessed on Apr. 1, 2021. (Year: 2012).*

*Primary Examiner* — Daniel J Colilla

(57) ABSTRACT

A vertical cylinder fitted into a 90 degree fitting that connects to a pipe organ air supply. Said pipe organ air supply is admitted into said 90 degree fitting thence to said cylinder ultimately urging a plunger to rise off of stop. Said plunger rises until it passes vents that allow said pipe organ air supply to exhaust to the atmosphere. Said plunger then descends. Said plunger continues to rise and fall in this fashion inducing rhythmic pulses of said pipe organ air supply until said pipe organ air supply is withdrawn. Said rhythmic pulses induce a change in pitch and amplitude of the pipe organ pipes when sounded thus providing a tremolo effect. Use of said plunger in this manner eliminates prior art usage of mechanical valves, fans and motors to induce a tremolo effect, and reduces the need for complex and expensive maintenance.

6 Claims, 1 Drawing Sheet

(56) References Cited

U.S. PATENT DOCUMENTS 3,449,995 A * 6/1969 Sepp, Jr. ..... G10H 1/24
84/345
4,319,513 A 3/1982 Peterson

* cited by examiner

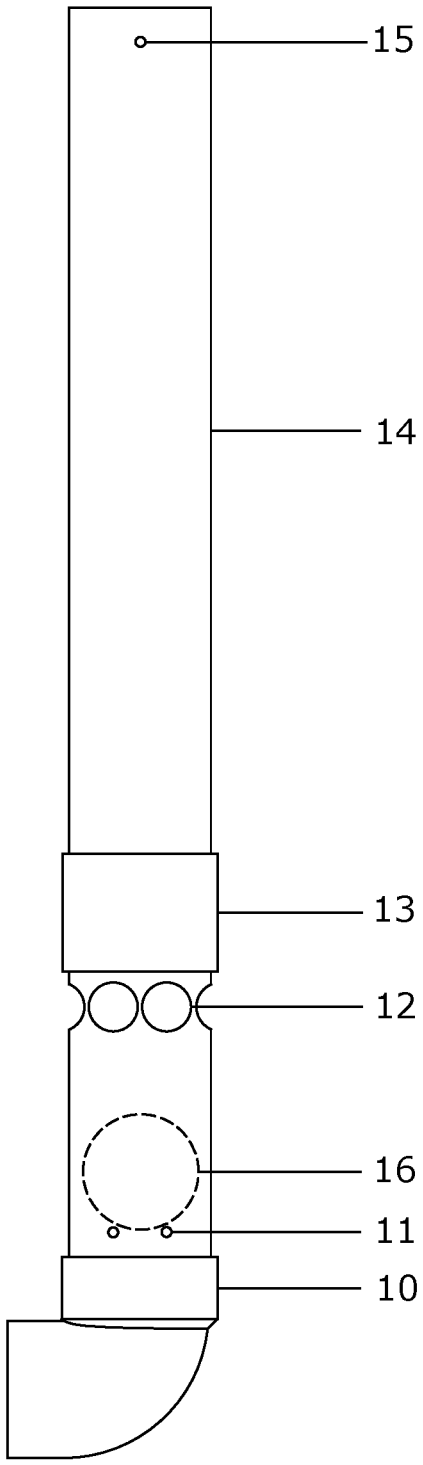
15
14
13
12
16
11
10

PIPE ORGAN TREMULANT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "SEQUENCE LISTING"

Not Applicable.

BACKGROUND OF THE INVENTION

Pipe organs have been provided with tremulants of various means to induce pitch variations in pipe organ pipes and have satisfied the need for such devices to a limited extent.

Valve means have been used in a pipe organ air supply to release rhythmic pulses of air to induce pitch variations in pipe organ pipes. These devices are complicated, unreliable and expensive to adjust and maintain for consistent performance. Such devices are well known in the prior art, and are illustrated in patents such as U.S. Pat. No. 478,552 to Basset, U.S. Pat. No. 797,719 to Challinor, U.S. Pat. No. 1,243,644 to Van Valkenburg. U.S. Pat. No. 1,262,640 to Cloetens, and U.S. Pat. No. 2,633,047 to Glatter-Gotz. Fan means have been used to disrupt the air flow either of a pipe organ air supply or the ambient air above pipe organ pipes to induce pitch variations in pipe organ pipes. Maintenance access for both is difficult and expensive, requiring considerable relocation of the pipe organ pipes and disassembly of the pipe organ air supply to access the fan. Further, the quality of the tremolo effect varies based on the distance from the pipe organ pipes to the location of the fan. Such devices exist in the prior art, and are illustrated in patents such as U.S. Pat. No. 203,932 to Potter and unpatented devices manufactured by G. W. Ingalls and Co. of Worcester Mass.

Eccentric weight means have been used to provide rhythmic increases in the pressure of a pipe organ air supply to induce pitch variations in pipe organ pipes. An eccentric weight is attached to the shaft of an electric motor that is mounted upon an air reservoir bellows. Activating the electric motor causes the air reservoir bellows to rise and fall and provide rhythmic increases in the pressure of the pipe organ air supply. The eccentric weight induces bearing damage to the electric motor. The eccentric weight means is unsatisfactorily noisy. The eccentric weight induces vibration and failure of the air reservoir bellows requiring frequent and expensive replacement of the air reservoir bellows. Movement of the electric motor feeder wires results in work hardening and embrittlement of the feeder wires requiring frequent replacement of broken wires. Such devices exist in the prior art, and are illustrated in patents such as U.S. Pat. No. 1,439,652 to Till, U.S. Pat. No. 2,198,160 to Gollnick, U.S. Pat. No. 3,018,682 to Imhoff and U.S. Pat. No. 4,319,513 to Peterson.

Ball means have been used in a pipe organ air supply to release rhythmic pulses of air to induce pitch variations in pipe organ pipes. Prior art ball means have required the continuous manual operation by the organist to provide a tremolo effect or have used a cord to suspend the ball which requires expensive replacement when frayed. Prior art ball means have been unsatisfactorily noisy. Such devices exist in the prior art, and are illustrated in patents such as U.S. Pat. No. 101,742 to Kerigan and U.S. Pat. No. 206,008 to Ewell.

Prior art methods for creating a tremolo effect are complicated, unreliable, inconsistent in effect, prone to failure and expensive to maintain.

BRIEF SUMMARY OF THE INVENTION

The present invention overcomes the difficulties of the prior art as outlined above. In accordance with one embodiment, the tremulant comprises a cylinder, a fitting, a bottom stop, vents, a sleeve, a top stop and a plunger. Accordingly several advantages of one or more aspects are as follows: inexpensive materials, ease of construction, simplified maintenance and consistent and reliable operation.

Other advantages of one or more aspects will be apparent from a consideration of the drawings and ensuing description.

BRIEF DESCRIPTION OF DRAWINGS

The single FIGURE shows one embodiment of the tremulant

DRAWINGS-REFERENCE NUMERALS

10 90 degree fitting
11 bottom stop
12 vents
13 sleeve
14 cylinder
15 top stop
16 plunger

DETAILED DESCRIPTION OF THE INVENTION

One embodiment of the tremulant is illustrated in the drawing. One end of a 90 degree fitting 10 is attached to an air supply of the pipe organ which is not shown. The other end of said 90 degree fitting 10 receives the vertical insertion of the bottom of cylinder 14. Said cylinder 14 has a bottom stop 11 located above the bottom of said cylinder 14 and below vents 12. Said bottom stop 11 supports plunger 16 when the tremulant is not in action. Said vents 12 have a total area equal or greater than the area of the cross section of said cylinder 14. Said cylinder 14 has a sleeve 13 used to adjust the amount of air vented through said vents 12. Said cylinder 14 has a top stop 15 located above vents 12 that prevents said plunger 16 from escaping said cylinder 14 if said sleeve 13 is blocking said vents 12.

When said air supply of the pipe organ is admitted to said 90 degree fitting 10, thence to said cylinder 14, said plunger 16 is urged off said bottom stop 11. Said plunger 16 then rises until passing said vents 12, at which point said air supply of the pipe organ is exhausted to the atmosphere. Said plunger 16, no longer supported by said air supply of the pipe organ, then descends below said vents 12. No longer vented to the atmosphere, said air supply of the pipe organ once again urges plunger 16 to rise until passing said vents 12. Said rising and descending of said plunger 16 continues until said air supply of the pipe organ is no longer admitted to said 90 degree fitting, thence to cylinder 14. The described movement of plunger 16 causes a rhythmic pulsing of said air supply of the pipe organ inducing a tremolo effect in the sounding of the pipes of a pipe organ. Sleeve 13 provides one means of adjusting the amount of air expelled from the vents 12 and thus the rate of the rhythmic pulsing induced by the movement of said plunger 16.

It is to be understood that the invention is not limited to the particular embodiment herein illustrated and described, as many variations may be made in the parts, their relative size, shape and positions without departing from the spirit of my invention as set forth in the following claims.

I claim:

1. A pipe organ tremulant for connection to a pipe organ air supply, comprising:

a cylinder having vents;

a 90 degree fitting connecting said cylinder to said pipe organ air supply;

a sleeve surrounding said cylinder to control the amount of said pipe organ air supply that is periodically exhausted from said vents;

a stop located below said vents of said cylinder;

a stop located above said vents of said cylinder; and a plunger located within said cylinder located between said bottom stop and said top stop and below said vents, when said plunger is at rest wherein said plunger is urged by said pipe organ air supply to rise above said vents resulting in the immediate exhausting of said pipe organ air supply thereby allowing said plunger to descend below said vents, in a repeating fashion, to produce corresponding changes in said pipe organ air supply thus providing a tremolo effect in a pipe organ.

2. The pipe organ tremulant of claim 1, wherein said bottom stop comprises at least one stop.

3. The pipe organ tremulant of claim 1, wherein said top stop comprises at least one stop.

4. The pipe organ tremulant of claim 1, wherein said plunger is of any weight allowing the free movement of said plunger between said bottom stop and said top stop when urged by said pipe organ air supply to rise above said vents resulting in the immediate exhausting of said pipe organ air supply thereby allowing said plunter to descend below said vents in a repeating fashion.

5. The pipe organ tremulant of claim 1, wherein said plunger is of any dimension allowing the free movement of said plunger within said cylinder while minimizing the passage of the pipe organ air supply around said plunger within said cylinder.

6. The pipe organ tremulant of claim 1, wherein said plunger is of any shape allowing the free movement of said plunger within said cylinder while minimizing the passage of the pipe organ air supply around said plunger within said cylinder.

* * * * *